US005966558A

United States Patent [19]

Kikui

[11] Patent Number: 5,966,558

[45] Date of Patent: Oct. 12, 1999

[54] IMAGE FORMING APPARATUS HAVING CONTROL OF EXPOSURE AND CHARGING DEPENDING ON DETECTED TEMPERATURE

[75] Inventor: Shinsuke Kikui, Yokohama, Japan

[73] Assignee: Ricoh Company, Ltd., Tokyo, Japan

[21] Appl. No.: 08/535,817

[22] Filed: Sep. 28, 1995

[30] Foreign Application Priority Data

Sep. 28, 1994 [JP] Japan ..... 6-233121

[51] Int. Cl.[6] ..... G03G 15/00

[52] U.S. Cl. ..... 399/44; 399/46; 399/50; 399/51

[58] Field of Search ..... 355/208, 214, 355/219, 246; 399/43, 44, 48, 49, 50, 51, 174, 176

[56] References Cited

U.S. PATENT DOCUMENTS

| | | | |
|---|---|---|---|
| 4,636,060 | 1/1987 | De Schamphelaere et al. . | |
| 4,816,871 | 3/1989 | Oushiden et al. . | |
| 4,870,460 | 9/1989 | Harada et al. | 355/246 |
| 5,237,369 | 8/1993 | Maruta et al. | 355/208 |
| 5,307,118 | 4/1994 | Morita | 355/208 |
| 5,606,399 | 2/1997 | Kikui | 399/168 |

FOREIGN PATENT DOCUMENTS

| | | |
|---|---|---|
| 61-072268 | 4/1986 | Japan . |
| 04034563 | 2/1992 | Japan . |
| 04186381 | 7/1992 | Japan . |
| 4-316064 | 11/1992 | Japan . |
| 05241428 | 9/1993 | Japan . |
| 6-186803 | 7/1994 | Japan . |
| 06230642 | 8/1994 | Japan . |

*Primary Examiner*—Robert Beatty

*Attorney, Agent, or Firm*—Oblon, Spivak, McClelland, Maier & Neustadt, P.C.

[57] ABSTRACT

The surface of a photosensitive body is evenly charged by a charging member, and then the charged surface is exposed to light by an exposure device in order to produce an electrostatic latent image. A toner is caused to adhere to the latent image by a developing roller and then is transferred to paper. The temperature of the charging member is detected by a temperature detecting device and, in accordance with the detected temperature, a voltage to be applied to the charging member is corrected by a voltage correcting device. An aging change of the photosensitive body is detected by an aging change detecting device and, in accordance with the amount of the aging change, a correction rule for an applied voltage corrected by the voltage correcting device is changed by a correction rule changing device. A potential of the surface of the charged photosensitive body or a developing bias of the developing roller in an image forming process is corrected by a potential correcting device. The surface of the photosensitive body is charged with the corrected voltage and then a reference potential pattern is formed. After the correction of the potential, the amount of light of the exposure device in the image forming process is corrected by an amount-of-light correcting device on the basis of a reference potential detected when the reference potential pattern is formed.

10 Claims, 7 Drawing Sheets

IMAGE FORMING APPARATUS HAVING CONTROL OF EXPOSURE AND CHARGING DEPENDING ON DETECTED TEMPERATURE

BACKGROUND OF THE INVENTION

1. Field of the Invention

This invention relates to an electrophotographic type of image forming apparatus, such as a laser printer, photocopying machine, or FAX machine. More specifically, this invention relates to an image forming apparatus in which a charging member is brought into contact with a rotating photosensitive body in order to charge the surface of the photosensitive body.

2. Description of the Prior Art

An electrophotographic type of image forming apparatus, such as a photocopying machine, is known in which an image is formed under the following process.

The surface of a drum-like or belt-like photosensitive body is evenly charged by a charger and then exposed by an exposing device so as to produce an electrostatic latent image thereon. After that, a toner is caused to adhere to the latent image on the surface of the photosensitive body by a developing roller disposed in a developing device so as to make the latent image visible. The image-visualized toner is then transferred to the surface of transfer paper supplied from a paper supplying unit by a transfer device. The toner which has been transferred to the surface of the transfer paper is fixed by a fixing device, and then the transfer paper is discharged. Finally, a toner left, if any, on the surface of the photosensitive body is removed by a cleaning device.

In this type of image forming apparatus, a corona discharge method is adopted in order to evenly charge the surface of the photosensitive body. According to this method, the surface of the photosensitive body is charged due to ionization of the surrounding air.

However, the corona discharge method has a problem in that a great quantity of ozone is produced when the surface of the photosensitive body is charged. The ozone has the characteristic that when a minus discharge is made, much more ozone is produced.

Nowadays, an organic photosensitive body for a minus discharge is widely used as photosensitive body. Also, the environmental standard for generation of various kinds of gasses including ozone has become severer. Thus, a countermeasure is keenly demanded. The corona discharge method also has a problem in that the adhesion of nitrogenous compounds (NOx), etc., which are secondarily produced by ozone, to the surface of the photosensitive body causes an abnormal image.

Accordingly, an image forming apparatus adopting a contact-and-charge method has been developed as a substitute of the corona discharge method. This new type of image forming apparatus employs a charging member, such as a charging roller, to be brought into contact with the surface of the photosensitive body. According to the contact-and-charge method, the charging roller supplied with voltage is brought into contact with the surface of the photosensitive body. The surface of the photosensitive body is evenly charged by electric discharge through an air gap which, in the strict sense of the word, exists between the respective surfaces of the charging roller and photosensitive body. Therefore, according to the contact-and-charge method, the voltage to be applied to the surface of the photosensitive body can be lowered compared with that of the corona discharge method. As a result, advantageously, the amount of ozone to be produced is sharply reduced.

However, even in the contact-and-charge method, there is a situation in which the photosensitive body is not evenly charged because of difficulty in maintaining a required electric potential at a constant level. In other words, the unevenness or nonuniformity of the charged photosensitive body is caused by the reason why changes in circumstances for the use of the apparatus, such as a change in temperature of the charging roller or a change in temperature of the inside of the apparatus, (in the following, these are referred to as apparatus circumstantial changes) lead to changes in electrical characteristics, such as a resistance value or dielectric constant, of the charging roller.

In order to prevent the nonuniformity generated when charged, such a technique as disclosed in Japanese Laid-Open Patent Application No. Hei 4-186381 is proposed. According to this technique, the temperature of a charging roller is detected by a sensor and then the voltage to be applied to the charging roller is changed in accordance with the detected temperature.

However, since the dependence of the surface potential of the photosensitive body upon the temperature is not in proportion to the applied voltage of the charging roller, it is still difficult to completely prevent the nonuniformity.

In addition, another problem residues in that the electric potential of the charged photosensitive body fluctuates because of the abrasion of a photosensitive layer of the photosensitive body caused by friction. As a solution to this problem, a technique is known in which the amount of abrasion of the photosensitive layer is detected and, in accordance with the increase of the detected abrasion, the voltage to be applied to the charging roller is decreased, as disclosed in Japanese Laid-Open Patent Application No. Hei 5-27557.

However, under the influence of the abrasion of the photosensitive layer, the characteristic of the photosensitive body depends upon the temperature of the charging roller. That is, the characteristic presented when the charging roller has a high temperature is opposite to that presented when the charging roller has a low temperature. Therefore, a surface potential of the photosensitive body cannot be always maintained constant even if the voltage to be applied to the charging roller is decreased.

There is still another problem. Generally, if a charging roller is used as a charging member, the diameter of the charging roller is such smaller than that of a photosensitive body with the view of making the charging roller small in size. For this reason, even in a case in which a small quantity of toner which has little influence on an image has adhered to the charging roller via a cleaning device, the toner becomes an obtrusive stain by the frequent occurrence of the toner thereto. As a result, such a stain causes a defective part which is not sufficiently charged.

It is therefore a first object of the present invention to provide an image forming apparatus which is capable of forming an image of stable quality regardless of whether or not, when a voltage to be applied is corrected in accordance with apparatus circumstantial changes, a photosensitive body has a physical change suffered with the lapse of time.

It is a second object of the present invention to provide an image forming apparatus which is capable of forming an image of stable quality regardless of whether or not, when a voltage to be applied is corrected in accordance with a physical change of a photosensitive body suffered with the lapse of time, there are apparatus circumstantial changes.

It is a third object of the present invention to provide an image forming apparatus which is capable of forming an image of stable quality, when an OPC (organic photoconductive cell) type of photosensitive body is used, regardless of apparatus circumstantial changes or a physical change of the photosensitive body suffered with the lapse of time.

It is a fourth object of the present invention to provide an image forming apparatus which is capable of forming an image of stable quality when an OPC (organic photoconductive cell) type of photosensitive body is used.

It is a fifth object of the present invention to provide an image forming apparatus which is capable of forming an image of stable quality by always making a potential of a charged photosensitive body constant regardless of apparatus circumstantial changes or a physical change of the photosensitive body suffered with the lapse of time.

It is a sixth object of the present invention to provide an image forming apparatus which is capable of forming an image of stable quality without fluctuation of a potential of a charged photosensitive body even when a correction rule is changed.

It is a seventh object of the present invention to provide an image forming apparatus which is capable of forming an image of stable quality by reducing defective areas of a charged photosensitive body caused by adhesion of a toner to a charging member.

It is an eighth object of the present invention to provide an image forming apparatus which is capable of effectively preventing a charging member from being stained for circumstantial changes at a low cost without detecting apparatus circumstantial changes by means of a newly disposed mechanism.

It is a ninth object of the present invention to provide an image forming apparatus which is capable of preventing an image from becoming dark for the decrease of the sensitivity of a photosensitive body in a low temperature.

It is a tenth object of the present invention to provide an image forming apparatus which is capable of preventing the deterioration of an image caused by apparatus circumstantial changes.

SUMMARY OF THE INVENTION

In order to achieve the objects, an image forming apparatus according to the present invention comprises a photosensitive body rotatable in a predetermined direction, a charging member that charges a surface of the photosensitive body by contact with the photosensitive body, an exposure device that exposes the surface of the photosensitive body charged by the charging member to light in order to produce an electrostatic latent image, a developing roller that causes a toner to adhere to the electrostatic latent image, a transfer device that transfers the toner to paper, a temperature detecting means for detecting temperature of the charging member, and a voltage correcting means for correcting a voltage to be applied to the charging member in accordance with the temperature detected by the temperature detecting means. The image forming apparatus further comprises an aging change detecting means for detecting an aging change of the photosensitive body, a correction rule changing means for changing a correction rule carried out for the applied voltage corrected by the voltage correcting means in accordance with an amount of aging change detected by the aging change detecting means, and an amount-of-light correcting means for correcting an amount of light of the exposure device during an image forming process in which the surface of the photosensitive body is charged with a voltage corrected by the voltage correcting means and then an image forming job of forming a reference potential pattern exposed to light sent out from the exposure device is carried out and thereafter a reference potential shown when the reference potential pattern is formed is detected and an image is transferred to paper.

Further, an image forming apparatus according to another aspect of the present invention comprises a photosensitive body rotatable in a predetermined direction, a charging member that charges a surface of the photosensitive body by contact with the photosensitive body, an exposure device that exposes the surface of the photosensitive body charged by the charging member to light in order to produce an electrostatic latent image, a developing roller that causes a toner to adhere to the electrostatic latent image, a transfer device that transfers the toner to paper, an aging change detecting means for detecting an aging change of the photosensitive body, and a voltage correcting means for correcting a voltage to be applied to the charging member in accordance with a detection result obtained by the aging change detecting means. The image forming apparatus further comprises a temperature detecting means for detecting temperature of the charging member, a correction rule changing means for changing a correction rule carried out for the applied voltage corrected by the voltage correcting means in accordance with temperature detected by the temperature detecting means, and an amount-of-light correcting means for correcting an amount of light of the exposure device during an image forming process in which the surface of the photosensitive body is charged with a voltage corrected by the voltage correcting means and then an image forming job of forming a reference potential pattern exposed to light sent out from the exposure device is carried out and thereafter a reference potential shown when the reference potential pattern is formed is detected and an image is transferred to paper. The image forming apparatus may further comprise a potential correcting means for correcting a potential of the surface of the photosensitive body which has been charged or a developing bias of the developing roller in the image forming process on the basis of a result obtained in such a way that a voltage corrected by the voltage correcting means is applied to the charging member in order to charge the surface of the photosensitive body and then electricity of the photosensitive body is removed and a residual potential after the removal is detected. In the image forming apparatus, correction of the potential of the surface of the photosensitive body is carried out by the potential correcting means prior to correction of the amount of light carried out by the amount-of-light correcting means.

Further, an image forming apparatus according to still another aspect of the present invention comprises a photosensitive body rotatable in a predetermined direction, a charging member that charges a surface of the photosensitive body by contact with the photosensitive body, as exposure device that exposes the surface of the photosensitive body charged by the charging member to light in order to produce an electrostatic latent image, a developing roller that causes a toner to adhere to the electrostatic latent image, a transfer device that transfers the toner to paper, a temperature detecting means for detecting temperature of the charging member, a voltage correcting means for correcting a voltage to be applied to the charging member in accordance with the temperature detected by the temperature detecting means, an aging change detecting means for detecting an aging change of the photosensitive body, a correction rule changing means for changing a correction rule carried out for the applied voltage corrected by the voltage correcting means in accordance with an amount of aging change detected by the aging change detecting means, a potential correcting means for correcting a potential of the surface of the photosensitive body which has been charged or a developing bias of the developing roller in the image forming process on the basis of a result obtained in such a way that a voltage corrected by the voltage correcting means is applied to the charging member in order to charge the surface of the photosensitive body and then electricity of the photosensitive body is removed and a residual potential after the removal is detected, and an mount-of-light correcting means for correcting an amount of light of the exposure device during an image forming process in which the surface of the photosensitive body is charged with a voltage corrected by the voltage correcting means after the correction of the potential by the potential correcting means and then an image forming job of forming a reference potential pattern exposed to light sent out from the exposure device is carried out and thereafter a reference potential shown when the reference potential pattern is formed is detected and an image is transferred to paper. In the image forming apparatus, the correction rule for the applied voltage corrected by the voltage correcting means is changed if a detection result obtained by the aging change detecting means exceeds a predetermined value after completion of the image forming job, and the voltage correcting means corrects a voltage applied to the charging member in accordance with temperature detected by the temperature detecting means under another correction rule presented by the correction rule changing means. The image forming apparatus may further comprise a cleaning means for cleaning the charging member before corrections are made by the amount-of-light correcting means and the potential correcting means. In the image forming apparatus, the charging member is cleaned by the cleaning means if temperature detected by the temperature detecting means is lower than a predetermined threshold value. Further, in the image forming apparatus, the amount-of-light correcting means and the potential correcting means make the respective corrections if temperature detected by the temperature detecting means is lower than a predetermined threshold value. Further, in the image forming apparatus, the amount-of-light correcting means and the potential correcting means make the respective corrections if temperature detected by the temperature detecting means exceeds a predetermined threshold value after the temperature is lower than the threshold value.

DETAILED DESCRIPTION OF THE EMBODIMENT

Figure 2:
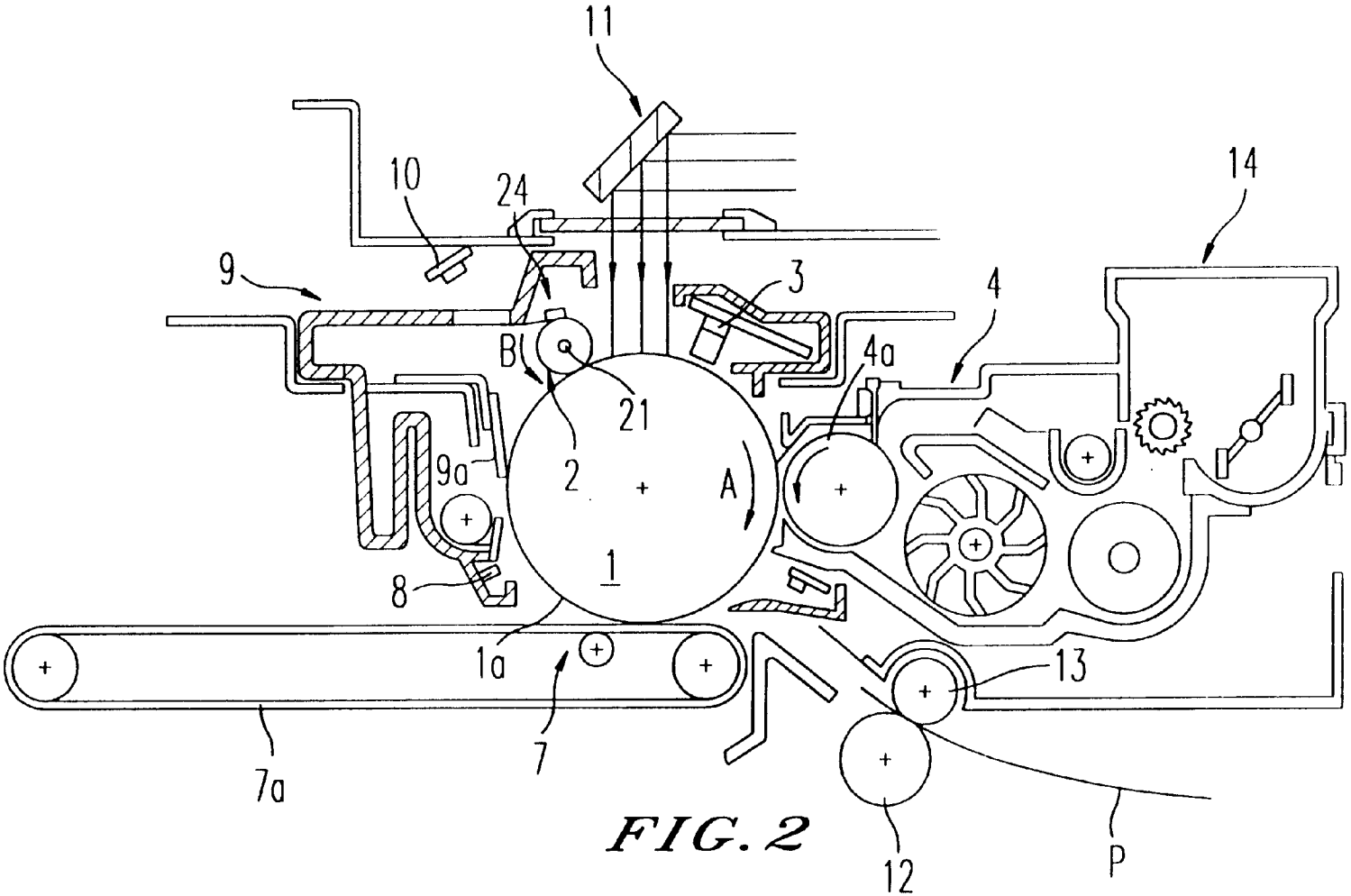
FIG. 2 is a schematic view showing a drum-like photosensitive body and component parts relative to the photosensitive body of a copying machine as an image forming apparatus according to the present invention.

An embodiment of the present invention will be described hereinafter with reference to the attached drawings. The embodiment is applied to a copying machine as an image forming apparatus. FIG. 2 is a schematic view showing a photosensitive body and component parts around the photosensitive body of a copying machine according to the present invention.

The copying machine shown in FIG. 2 is a contact-and-charge type and includes a drum-like photosensitive body 1 as a body to be charged, and a charging roller 2 as a charging member, which is to be brought into contact directly with the photosensitive body 1. In this contact-and-charge type of copying machine, a preset voltage is applied to the charging roller 2, so that a surface 1*a* of the photosensitive body 1 is evenly charged to a predetermined electric potential. When the photosensitive body 1 is rotated in the direction of arrow A at a predetermined peripheral speed, the charging roller 2 is also rotated in the direction of arrow B (i.e., in the opposite direction to that of arrow A) while contacting and following the photosensitive body 1.

The photosensitive body 1 is rotationally driven by a driving unit including a drum-driving-timing-belt, a drum driving pulley, a motor for driving them, and the like (each not shown). The charging roller 2 is in contact with the surface 1*a* under a predetermined pressure at all times. In addition to the charging roller 2, an eraser 3, a developing device 4, a contact type of transfer device 7 having an endless belt 7*a,* a P-sensor 8, a cleaning unit 9, and a quenching lamp 10 are arranged around the photosensitive body 1.

During a usual development process, the charging roller 2 charges the surface 1*a* to a predetermined electric potential (for example—900V). The charged surface 1*a* is exposed to light, which corresponds to an image of, for example, original printed matter to be copied, sent out from an exposure device 11 (only a mirror portion is shown in FIG. 2), thereby producing an electrostatic latent image thereon. An electrostatic charge in areas of the electrostatic latent image thus produced, which go beyond the size of a transfer paper P in use is trimmed off by the eraser 3. The remaining part of the electrostatic latent image within the size of the transfer paper P is made visible (i.e., is developed) by a toner supplied from a developing roller (developing sleeve) 4*a* of the developing device 4.

On the other hand, the transfer paper P in a paper feeding cassette (not shown) is fed, one by one, by a paper feeding roller rotating at a predetermined timing. The transfer paper P thus fed is temporarily stopped between a resist roller 12 and a pressure roller 13 rotating in a pressure contact state with the resist roller 12, so that a timing adjustment is made. This timing adjustment is made such that the transfer paper P thus fed and the toner image (visible image) on the surface 1*a* correctly coincide with each other. The adjusted transfer paper P is fed toward a transfer portion having the transfer device 7.

The transfer paper P thus fed to the transfer portion is supplied with a transfer bias by the transfer device 7 and is carried to a fixing device. While the transfer paper P is being carried to the fixing device, the toner image separated from the photosensitive body 1 is transferred to an upper surface (in FIG. 2) of the transfer paper P. The fixing device gradually fixes the toner image on the transfer paper P by heat and then discharges the paper P into a tray disposed outside the apparatus body.

On the other hand, foreign substances, such as a toner left when the toner image is transferred to the transfer paper P, paper powder of the transfer paper P, or the like, adhere to the surface 1*a*. The foreign substances are removed from the surface 1*a* by a cleaning blade 9*a* disposed on a cleaning unit 9. Preparatory to next charging made by the charging roller 2, a residual electric potential left on the photosensitive body 1 is removed by the quenching lamp 10 (electricity removing device). Thereafter, the above-mentioned consecutive steps from the charging to the discharging are repeated.

Figure 3:
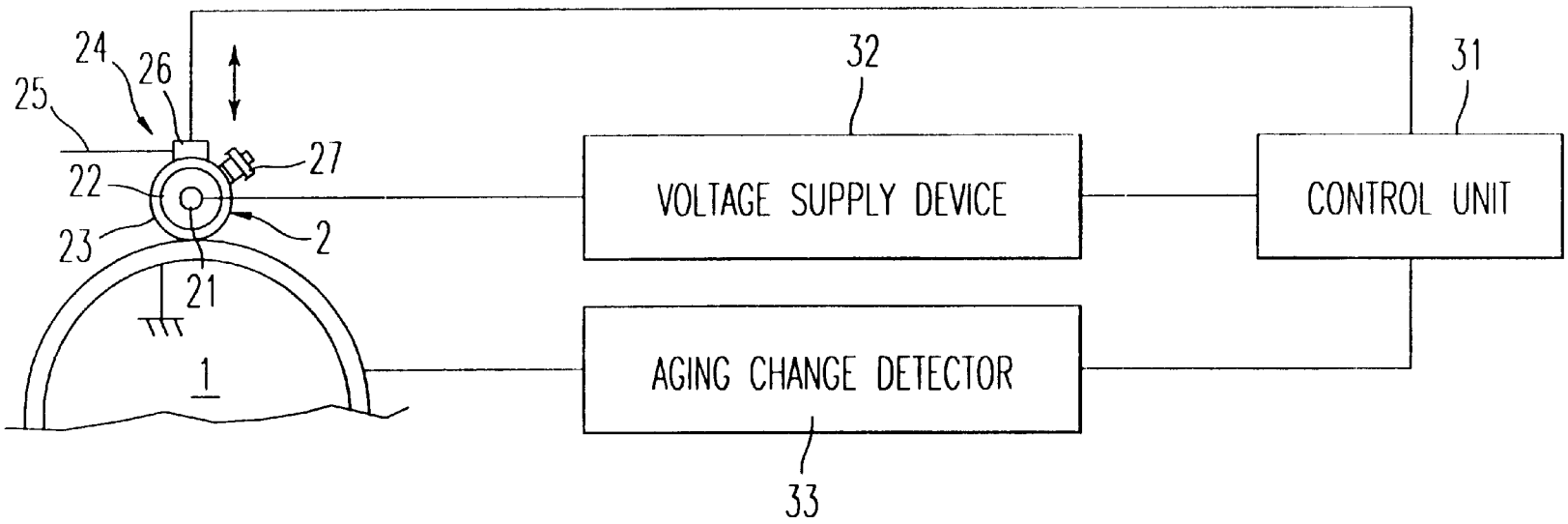
FIG. 3 is a descriptive drawing of a main portion of FIG. 2 and a control system.

FIG. 3 is a view showing a main portion of FIG. 2 and a control system. The charging roller 2 includes a conductive core 21 made of iron or the like, a resilient layer 22 made of epichlorohydrine rubber attached to an outer periphery of the conductive core 21, and a surface layer 23 formed of a mixture, in which lumifreon and hydrine rubber are dispersed, applied to the surface of the resilient layer 22.

Figure 1:
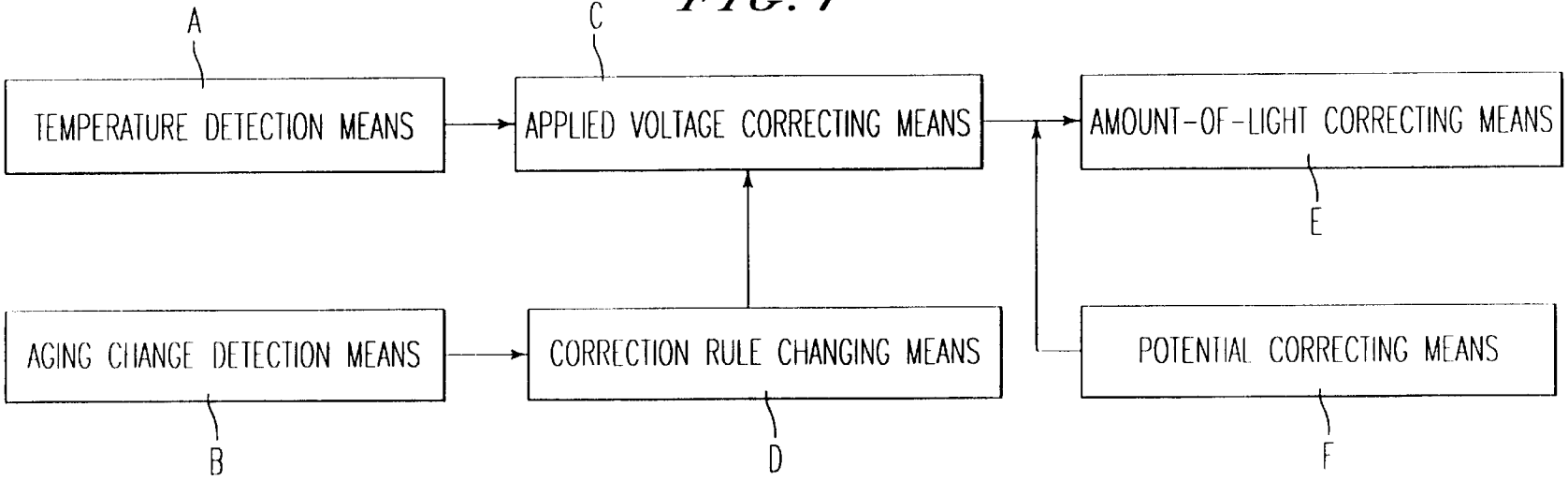
FIG. 1 is a functional block diagram showing a basic construction of an image forming apparatus according to an embodiment of the present invention.

Reference numeral 24 designates a temperature detecting portion corresponding to a temperature detection means B of FIG. 1. The temperature detecting portion 24 comprises a temperature detecting element 26, such as a thermistor, firmly secured to an end of a conductive spring 25. The temperature detecting element 26 is in contact with the surface of the charging roller 2 through a film material (not shown). By this, the temperature of the charging roller 2 is detected and a detection result is output to a control unit 31.

Reference numeral 27 designates a cleaning member which is located away from the charging roller 2. The cleaning member 27 serves to contact and clean the surface of the charging roller 2 by means of a driver (not shown). The cleaning member 27 is brought into contact with the charging roller 2 with a predetermined timing a description of which will be given later.

A general purpose microcomputer is used as the control unit 31 for systemically controlling respective parts of the copying machine. The control unit 31 also serves as a voltage correcting means C, a correction rule changing means D, an amount-of-light correcting means E, and a potential correcting means F each shown in FIG. 1.

Reference numeral 32 designates a voltage applying device. The voltage applying device 32 applies a voltage to the conductive core 21 with a predetermined timing. As a result, the surface 1*a* is evenly charged.

Reference numeral 33 designates an aging change detecting device which corresponds to an aging change detection means B of FIG. 1. The aging change detecting device 33 detects an aging change of the photosensitive body 1 (i.e., a physical change which the photosensitive body 1 has suffered with the lapse of time). The detection result is output to the control unit 31. In this embodiment, the aging change of the photosensitive body 1 is represented as an accumulated rotation time, and the aging change detector 33 counts (detects) the duration by means of a timer/counter.

A brief description will now be given of the control of the density of a toner performed by the P-sensor 8 of the copying machine.

In the copying machine, for example, every time the predetermined number of copies is finished (in other words, every time an image forming process is completed), the P-sensor 8 controls the density of the toner.

First, the endless belt 7*a* of the transfer device 7 is separated from the surface 1*a* of the photosensitive body 1 by a driver (not shown).

After that, the charging roller 2 charges the surface 1*a* to a predetermined potential (for example, —600 V). As a result, an electrostatic latent image, which is exposed to light sent out from the exposure device 11 and reflected by a P-sensor pattern plate (not shown) on which a pattern for density control is formed, is produced on the charged surface 1*a*. The electrostatic latent image is made visible by the developing roller 4*a* of the developing device 4, so that a pattern image for density control is formed.

An amount of toner attracted to the pattern image for density control is measured by the P-sensor 8 comprising a photo sensor or the like. An amount of toner to be supplied to the developing device 4 from the toner supplying device 14 is controlled so that a measurement result becomes a predetermined value. Thereafter, the endless belt 7*a* of the transfer device 7 is brought into contact with the surface 1*a* of the photosensitive body 1.

The electric resistance of the charging roller 2 is largely influenced by the temperature of the inside of the copying machine. In addition, the electric potential of the photosensitive body 1 which has been charged is influenced by an abrasion loss of the surface of the photosensitive body 1. According to the change of the electric potential, the control unit 31 performs various processes, such as correction of a voltage applied to the charging roller 2 by means of the voltage applying device 32, based on detection results obtained by the temperature detecting portion 24 and the aging change detector 33. These processes are described in detail later. A brief description will now be given of VR correction (residual potential correction) and VL correction (surface potential control) which are generally made in the copying machine.

The VR and VL corrections include a process of measuring an amount of toner attracted to a predetermined potential pattern image formed on the photosensitive body 1 by means of the P-sensor 8. Therefore, it is required that the endless belt 7*a* of the transfer device 7 is away from the surface 1*a* of the photosensitive body 1.

Accordingly, in the VR correction carried out before the VL correction, the following steps are consecutively taken in a state in which the endless belt 7*a* of the transfer device 7 is away from the surface 1*a* by means of a driver.

The surface 1*a* of the photosensitive body 1 is first charged by the charging roller 2 to a predetermined potential (—900V in this embodiment), and then electricity is removed by an eraser so as to form a residual potential pattern on the surface 1*a*. After that, the residual potential pattern is made visible by the developing roller 4*a* of the developing device 4 (developing bias=0V). A residual potential is detected by measuring the amount of toner adhering thereto by means of the P-sensor 8. According to the detection result, corrections are made to the potential of the surface 1*a* of the photosensitive body 1 in the image forming process and to the developing bias of the developing roller 4*a*. In other words, the potential to be charged and the developing bias are increased proportionately with the increase of the residual potential.

This VR correction brings about a constant relationship (i.e., developing bias>surface potential) between the developing bias of the developing roller 4*a* and the surface potential of the surface 1*a* of the photosensitive body 1. The developing potential (i.e., value obtained by subtracting the developing bias from the potential to be charged) also becomes constant. As a result, an image of high quality without dirt on its ground is ensured. After the completion of the VR correction, the VL correction is carried out. As in the VR correction, the following steps of the VL correction are also consecutively taken in the state in which the endless belt 7*a* of the transfer device 7 is away from the surface 1*a* by means of the driver.

The surface 1*a* of the photosensitive body 1 is first charged by the charging roller 2 to a predetermined potential (—900V in this embodiment), and then a reference potential pattern is formed by exposing it to light sent out from the exposure device 11 and reflected by a VL pattern plate (not shown) on which a reference density pattern of low density is formed. After that, the reference potential pattern is made visible by the developing roller 4*a*. A reference potential is detected by measuring the amount of toner adhering thereto by means of the P-sensor 8. The voltage of an exposing lamp of the exposure device 11 (i.e., an amount of light from the exposure device 11) during the image forming process is controlled so that a detection result becomes a predetermined value. The endless belt 7*a* of the transfer device 7 is then brought into contact with the surface 1*a* of the photosensitive body 1.

This VL correction brings about the constant regeneration of half tone, thus ensuring an image of high quality.

As mentioned above, the VL correction is carried out after the completion of the VR correction. Therefore, in the VL correction, a reference potential pattern image (VL pattern image) is formed on the photosensitive body 1 under a potential to be charged and a developing bias which are obtained by the VR correction. Accordingly, an image in which the influence of the residual potential is more lessened can be obtained.

Figure 4:
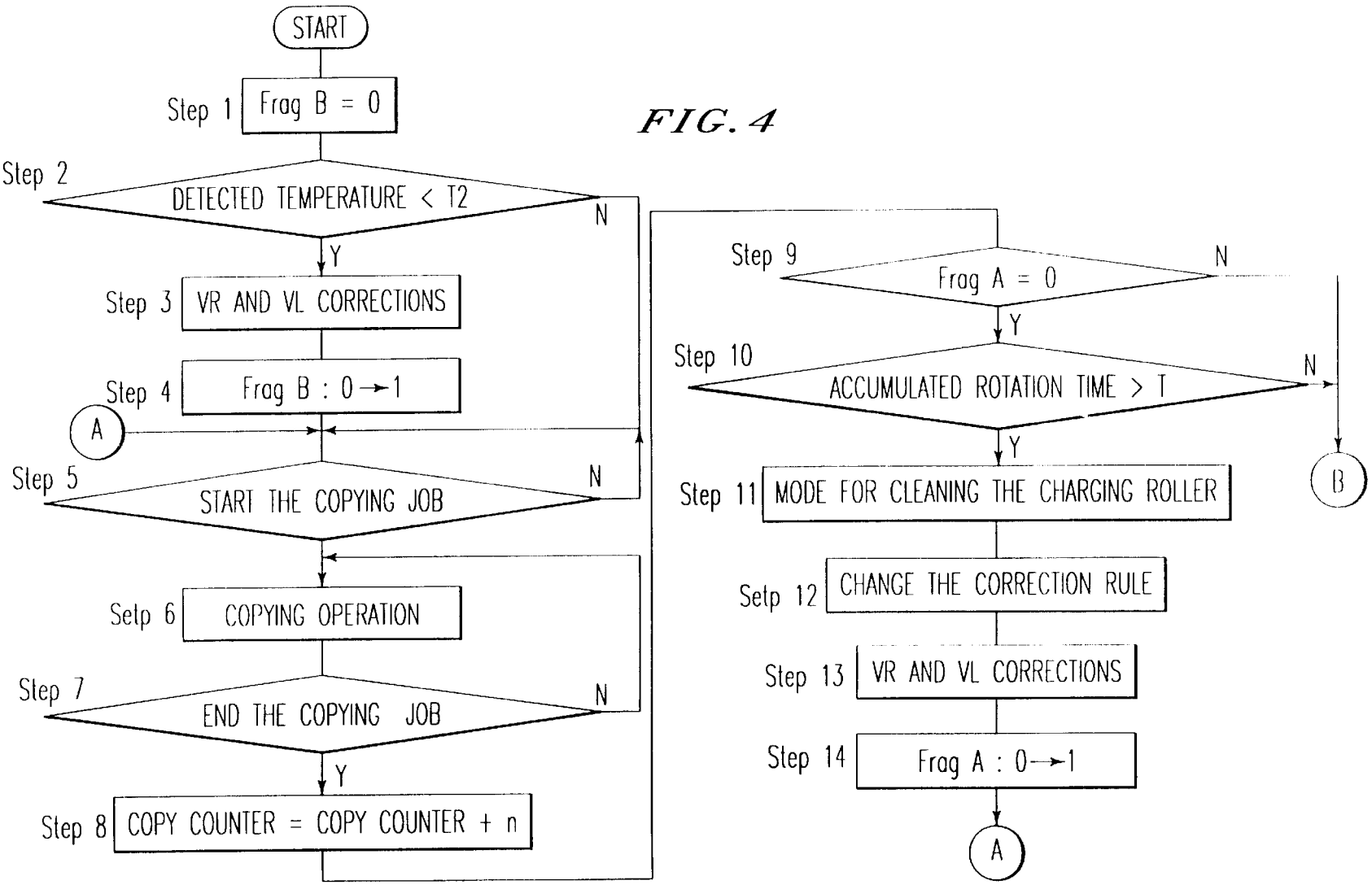
FIG. 4 is a flow chart of one example of a control operation performed by a control unit of FIG. 3.
Figure 5:
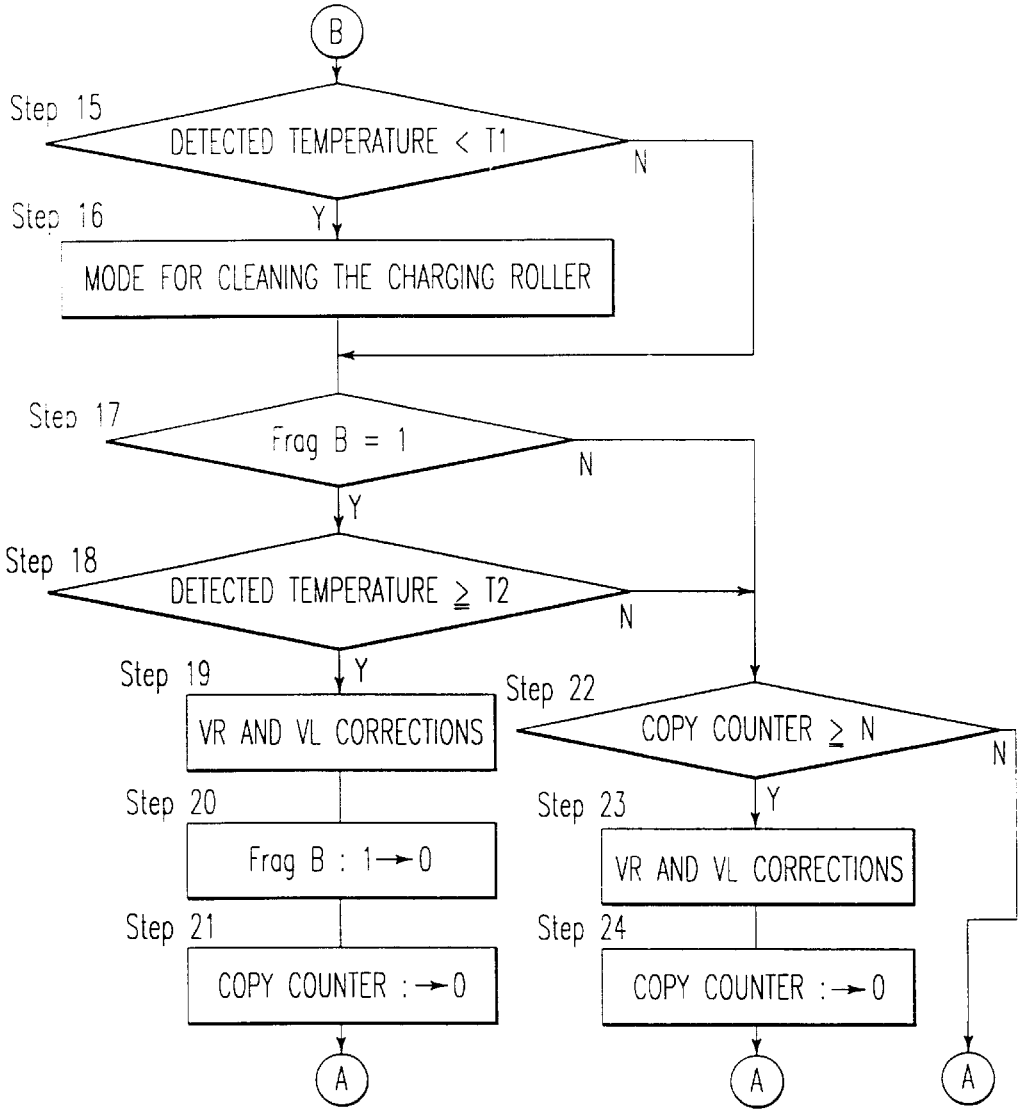
FIG. 5 is a flow chart of a control operation subsequent to that of FIG. 4.

FIGS. 4 and 5 are flow charts showing an example of the control of the control unit 31.

This routine starts when a main switch (not shown) is turned on.

In Step 1, initialization is carried out to be Frag B=0. In Step 2, a judgment is made as to whether a temperature detected by the temperature detecting portion 24 is lower than a predetermined second temperature T2 (20° C. in this embodiment)or not.

If the detected temperature is not lower than the second temperature T2, the stage is shifted from Step 1 immediately to Step 5. If the detected temperature is lower than the second temperature T2, the VR and VL corrections are carried out in Step 3, and then the stage is shifted to Step 4. In Step 4, Frag B is caused to become 1, and then the stage is shifted to Step 5.

In Step 6, a judgment is made as to whether a copying job (image forming job) has started (i.e., a start key, not shown, has been pushed) or not. When the copying job starts, the stage is shifted to Step 6 where a copying operation for a first copy is performed.

Referring again to Step 3, when the VR and VL corrections are carried out in Step 3, the voltage applied to the charging roller 2 is corrected with reference to a correction rule and in accordance with a temperature detected by the temperature detecting portion 24.

Figure 6A:
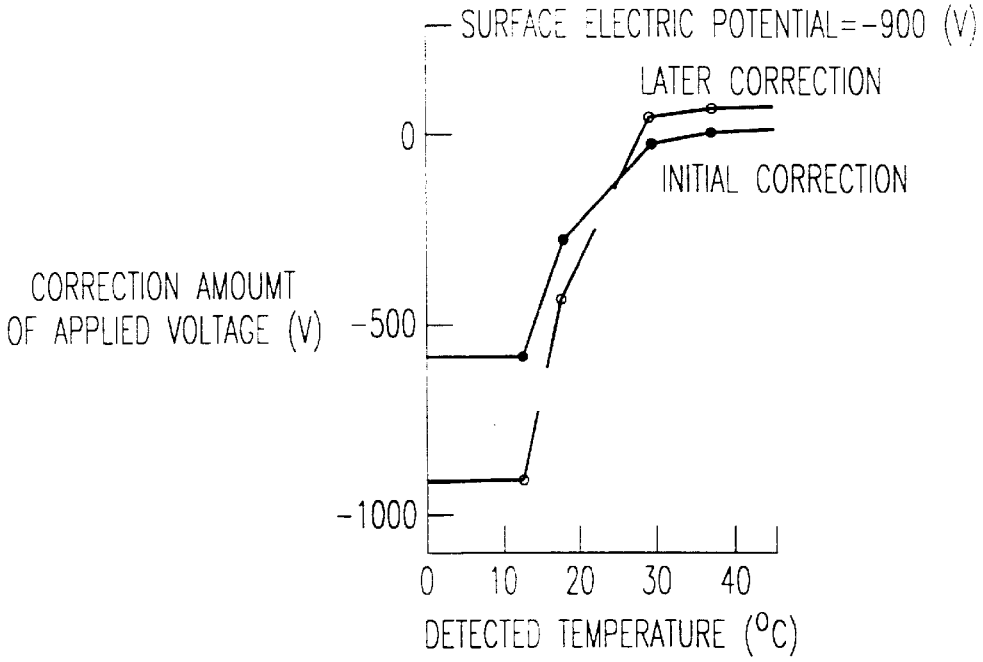
FIG. 6(*a*) is a graph showing a relationship between a temperature detected by a temperature detecting unit and an amount of correction of a voltage to be applied to a charging roller when a surface electric potential of a photosensitive body is brought to be—900V, and FIG. 6(*b*) is a graph showing a relationship between a temperature detected by the temperature detecting unit and an amount of correction of a voltage to be applied to the charging roller when a surface electric potential of the photosensitive body is brought to be—600V, according to the present invention.
Figure 6B:
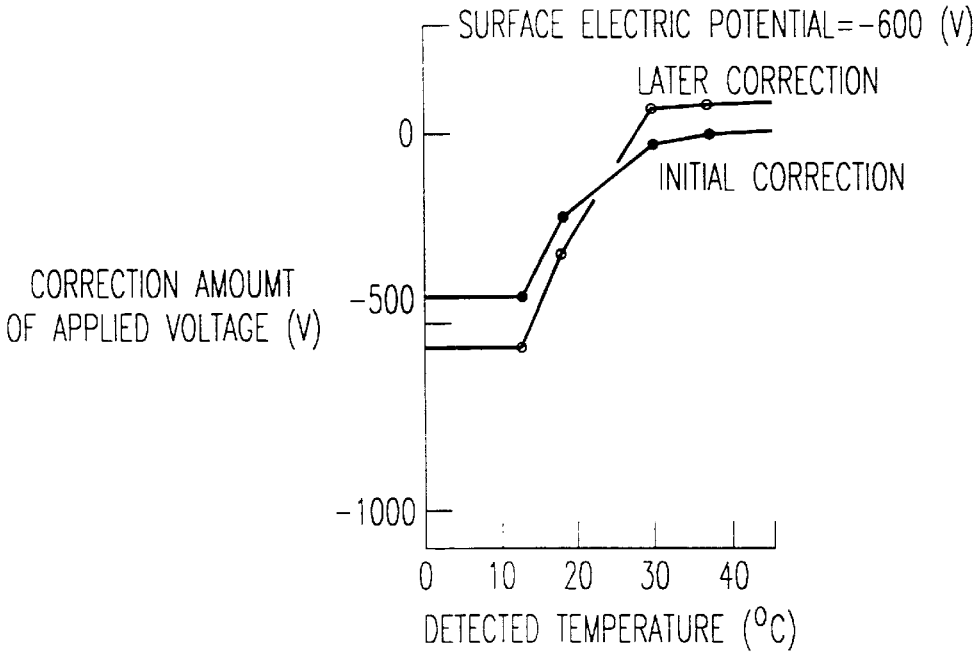
Figure 7:
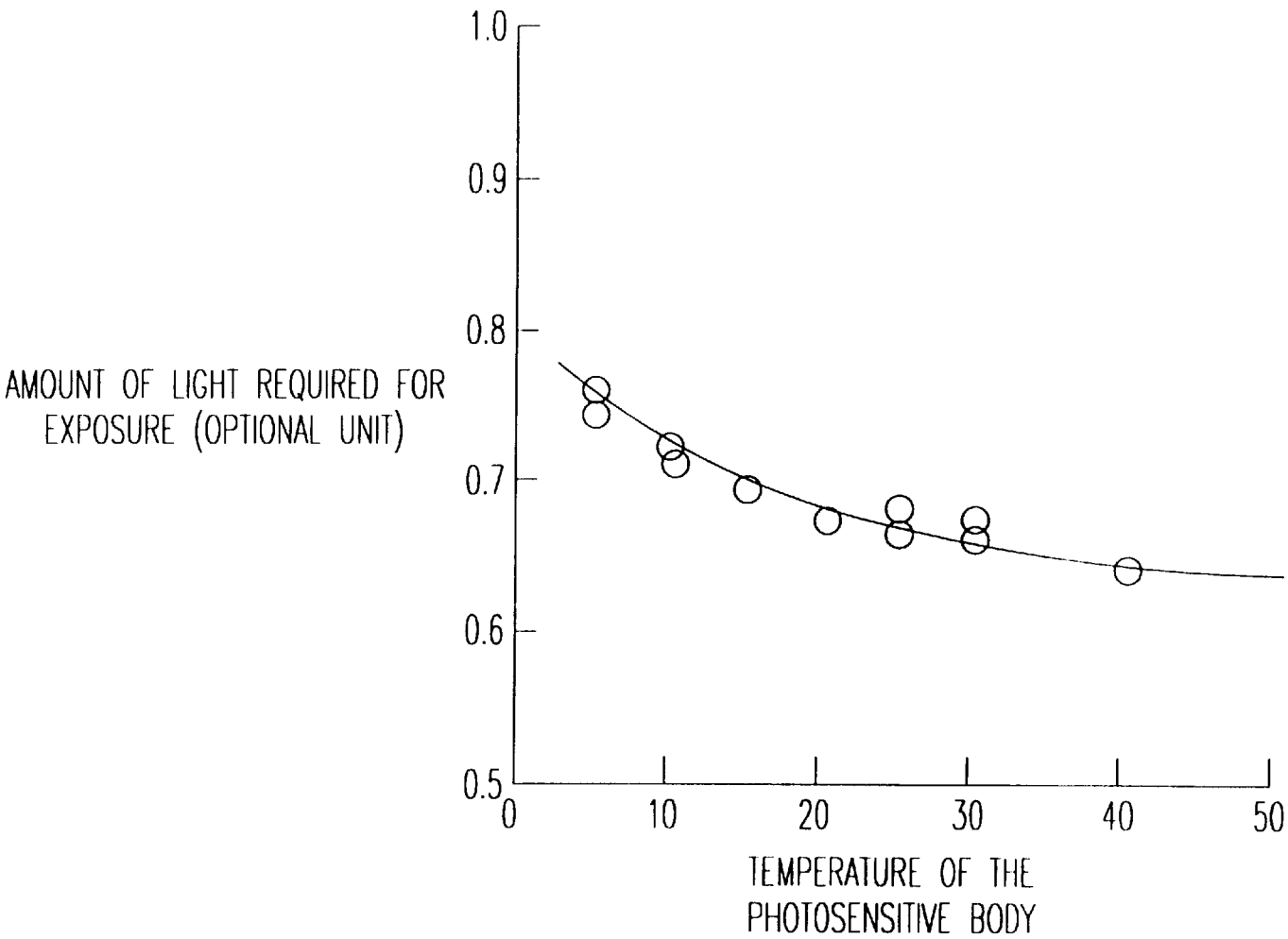
FIG. 7 is a graph showing a relationship between a temperature of the photosensitive body shown in FIG. 2 and an amount of exposure to be required.

FIGS. 6(*a*) and 6(*b*) each show a relationship between the temperature detected by the temperature detecting portion 24 and an amount of correction of the voltage applied to the charging roller 2 when a voltage (surface voltage) of the photosensitive body 1 which has been charged is—900V and—600V, respectively. The data on the relationship is planted in a ROM of the control unit 31 in the form of a correction table.

When the first copying operation is completed, a judgment is made as to whether a copying job has finished (whether the predetermined number of copies of the original printed matter has been made) or not in Step 7. If not, the copying job is continued. When the copying job is completed, the stage is shifted to Step 8.

In Step 8, an increment (+n) of the predetermined number of copies is given to a copy counter (not shown), and then the stage is shifted to Step 9.

In Step 9, a judgment is made as to whether Frag A is 0 or not. Frag A is initialized to be 0 zero) when the operation of the copying machine is started. Even through Frag A becomes 1 (one) in the following stages, Frag A is again initialized to be 0 whenever the photosensitive body 1 is replaced with a new one. If Frag A=0, the stage is shifted to Step 10.

In Step 10, a judgment is made as to whether an accumulated rotation time, which is calculated by a routine (not shown), of the photosensitive body 1 has reached a predetermined time t (for example, 40 hours). If the judgment result is affirmative, the stage is shifted to Step 11.

In Step 11, a mode for cleaning the charging roller 2 is selected. The cleaning member 27 is brought into contact with the charging roller 2 and cleans the surface of the charging roller 2. When the cleaning is completed, the cleaning member 27 is separated from the charging roller 2. The cleaning prevents a decrease in charging ability of the charging roller 2 (decrease in potential) caused by, for example, a toner left on the charging roller 2.

When the cleaning is completed, the stage is shifted to Step 12. In Step 12, using the correction table mentioned above, there is changed a correction rule to which reference is made when a voltage to be applied to the charging roller 2 is changed in accordance with a temperature detected by the temperature detecting portion 24. In this embodiment, it is required that a potential of the photosensitive body 1 to be charged is—900V when the VR and VL corrections are carried out. Therefore, a voltage to be applied to the charging roller 2 according to the correction rule shown by the continuous line of FIG. 6(*a*) is changed to that according to the other correction rule shown by the broken line of FIG. 6(*a*). Therefore, the stage is shifted to Step 13.

In Step 13, the VR and VL corrections are carried out. At the same time, the voltage applied to the charging roller 2 is changed with reference to the new correction rule and in accordance with the temperature detected by the temperature detecting portion 24.

Thereafter, Frag A is made to be 0 in order not to repeat the procedures of Steps 11–14, and then the stage is shifted to Step 5. In Step 5, a judgment is again made as to whether the copying job has started or not, and the same procedures as mentioned above are repeated.

On the other hand, if it is judged that Frag A is not 0 in Step 9 or that the accumulated rotation time of the photosensitive body 1 has not yet reached the predetermined time t in Step 10, the stage is shifted to Step 15 (see FIG. 5).

In step 15, a judgment is made as to whether a temperature detected by the temperature detecting portion 24 is lower than a predetermined first temperature T1 (18° C. is this embodiment) or not. If not, the present state is maintained. If the detected temperature is lower than the first temperature T1, the stage is shifted to Step 16.

In Step 16, a cleaning mode is selected to clean the surface of the charging roller 2 and then the same procedure as in Step 11 is performed. Thereafter, the stage is shifted to Step 17.

In Step 17, a judgment is made as to whether Frag B is 1 (one) or not. If Frag B=1, the stage is shifted to Step 18 to make a judgment as to whether a temperature detected by the temperature detecting portion 24 is more than the predetermined second temperature T2 or not.

If the detected temperature is more than the second temperature T2, the stage is shifted to Step 19. In Step 19, the VR and VL corrections are carried out. At the same time, the voltage applied to the charging roller 2 is corrected with reference to the present correction rule and in accordance with the temperature detected by the temperature detecting portion 24.

When the VR and VL corrections are completed, the stage is shifted from Step 19 to Step 20. In Step 20, Frag B is made to be 0. Thereafter, the copy counter is reset to be 0 in Step 21, and then the stage returns to Step 5 from Step 21.

If it is judged that Frag B is not 1 (one) in Step 17 or that the detected temperature is not more than the second temperature T2 in Step 18, the stage is shifted to Step 22.

In Step 22, a judgment is made as to whether a count value (accumulated sheets of paper which has been copied) of the copy counter has reached the predetermined number N of copies (for example, 1000 sheets of paper) or not. If the count value has reached the predetermined number N, the VR and VL corrections are carried out in Step 23 as in the above step, and then the copy counter is reset to be 0 in Step 24. Thereafter, the stage returns to Step 5 from Step 24.

As described above, in the copying machine of this embodiment, when an amount of aging change (i.e., an accumulated rotation time) of the photosensitive body 1 detected by the aging change detector 33 after the completion of the copying job 33 exceeds a predetermined amount of time, the cleaning member 27 cleans the charging roller 2, and then a correction rule which is required for correcting a voltage applied to the charging roller 2 is changed. After that, the VR and VL corrections are made, and then the copying procedures subsequent thereto are carried out.

Therefore, the potential of the surface 1*a* of the photosensitive body 1 which has been charged does not vary even when the corrections rule is changed. In other words, regardless of apparatus circumstantial changes or again changes, the potential of the surface 1*a* is always kept constant and therefore an image of stable quality can be obtained.

In addition, since the cleaning member 27 cleans the charging roller 2 when the temperature detected by the temperature detecting portion 24 is lower than a threshold value (predetermined temperature T1), the following effect can be obtained. A small amount of toner is still left on the surface 1*a* of the photosensitive body 1 which has been cleaned by the cleaning unit θ. Since the remaining toner thereon adheres to the surface 1*a* of the photosensitive body 1 chiefly by an image-force of its own electric charge, toners are liable to be additionally attracted thereto in a low temperature and low humidity. However, since the cleaning member 27 cleans the charging roller 2, there is no need of detecting apparatus circumstantial changes by means of a new mechanism, and thus it is possible to effectively and at a low cost prevent the charging member from being stained with toners or foreign substances caused by circumstantial changes.

In addition, since the VR and VL corrections are carried out when the temperature detected by the temperature detecting portion 24 is lower than a threshold value (predetermined temperature T2), the following effect can be obtained. The sensitivity of the photosensitive body 1 is lowered as the temperature becomes lower, and the temperature of the photosensitive body 1 are abruptly changed in proportion to the increase of an amount of exposure to be required. If the amount of exposure in a high temperature is constantly kept, an image to be obtained becomes dark. However, the VR and VL corrections (including a procedure of increasing an amount of exposure) prevent an image from becoming dark for the decrease of the sensitivity of the photosensitive body 1 in a low temperature.

In addition, even in a case in which the temperature detected by the temperature detecting portion 24 is lower than a predetermined threshold value (predetermined temperature T2) and then exceeds the value, the VR and VL corrections are carried out. Therefore, the deterioration of an image caused by apparatus circumstantial changes is prevented.

Referring to the VR and VL corrections in this embodiment, a technique is disclosed for detecting a residual potential or a reference potential by measuring an amount of adhering toner of a residual potential pattern image or a reference potential pattern image, which is formed on the surface 1*a* of the photosensitive body 1, by means of the P-sensor 8. Instead of this technique, a potential of a residual potential pattern or a potential of a reference potential pattern prior to being made visible by the developing device 4 (i.e., residual potential or reference potential) may be directly detected by disposing an electrometer for measuring the surface potential of the photosensitive body 1 in front of the developing device 4.

In this embodiment, a preferred example is disclosed in which both the VR correction and the VL correction are carried out each at a predetermined timing as shown in FIGS. 4 and 5. Instead, only the VL correction may be carried out. Thereby, if a selenium type of photosensitive body is used, a potential of the photosensitive body to be charged can be made constant regardless of apparatus circumstantial changes or again changes.

In addition, the VL correction or the VR and VL corrections may be carried out on the basis of not only a detected temperature but also the thickness of the photosensitive layer of a photosensitive body or, in contrast, on the basis of not only the thickness of the photosensitive layer of a photosensitive body but also a detected temperature.

In the above description, the image forming apparatus according to the present invention is applied to the copying machine. However, the present invention is, of course, applicable to other electrophotographic types of image forming apparatus, such as an optical printer (for example, a laser printer, LED printer, or liquid-crystal shutter printer) or Fax machine. In addition, a belt type of photosensitive body may be used instead of the drum type.

As described above, according to the present invention, a potential of a charged photosensitive body can be always made constant regardless of apparatus circumstantial changes or aging changes (physical changes of the photosensitive body suffered with the lapse of time), and thus an image of stable quality can be obtained.

Further, according to the present invention, the potential of the charged photosensitive body does not fluctuate even when a correction rule is changed, and thus an image of stable quality can be obtained.

Further, according to the present invention, defects in charging the photosensitive body are reduced without staining the charging member with a toner, and thus an image of stable quality can be obtained.

Further, according to the present invention, stains of the charging member caused by circumstantial changes can be effectively and at a low cost prevented because there is no need of detecting apparatus circumstantial changes by means of a newly disposed mechanism.

Further, according to the present invention, an image can be prevented from becoming dark for the decrease of the sensitivity of the photosensitive body in a low temperature.

Further, according to the present invention, the deterioration of an image caused by apparatus circumstantial changes can be prevented.

What is claimed is:

1. In an electrophotographic type of image forming apparatus comprising:

a photosensitive body rotatable in a predetermined direction;

a charging member that charges a surface of said photosensitive body by contact with said photosensitive body;

an exposure device that exposes the surface of said photosensitive body charged by said charging member to light in order to produce an electrostatic latent image;

voltage correcting means for correcting a voltage to be applied to said charging member;

temperature detecting means for detecting a temperature of said charging member, amount-of-light correcting means for correcting an amount of exposure light of said exposure device;

aging change detecting means for detecting an aging change of said photosensitive body;

correction rule changing means for changing a correction rule carried out for the applied voltage corrected by said voltage correcting means in accordance with an amount of aging change detected by said aging change detecting means;

wherein, when a direction result obtained by said temperature detecting means is lower than a predetermined temperature value, said voltage correcting means first makes correction of the applied voltage under another correction rule presented by said correction rule changing means, and consecutively said amount-of-light correcting means makes correction of the amount of exposure light.

2. In an electrophotographic type of image forming apparatus comprising:

a photosensitive body rotatable in a predetermined direction;

a charging member that charges a surface of said photosensitive body by contact with said photosensitive body;

an exposure device that exposes the surface of said photosensitive body charged by said charging member to light in order to produce an electrostatic latent image;

temperature detecting means for detecting a temperature of said charging member;

voltage correcting means for correcting a voltage to be applied to said charging member;

amount-of-light correcting means for correcting an amount of exposure light of said exposure device;

aging charge detecting means for detecting an aging change of said photosensitive body; and correction rule changing means for changing a correction rule carried out for the applied voltage corrected by said voltage correcting means in accordance with the temperature detected by said temperature detecting means;

wherein, when a detection result obtained by said temperature detecting means is lower than a predetermined temperature value, said voltage correcting means first makes correction of the applied voltage under another correction rule presented by said correction rule changing means, and consecutively said amount-of-light correcting means makes correction of the amount of exposure light.

3. An electrophotographic type of image forming apparatus according to claims 1 or 2, further comprising potential correcting means for correcting a potential of the surface of said photosensitive body which has been charged in an image forming process proceeding from charge to transfer on the basis of a detection result obtained in such a way that a voltage corrected by said voltage correcting means is applied to said charging member in order to charge the surface of said photosensitive body and then electricity of said photosensitive body is removed and a residual potential after the removal is detected.

4. An image forming apparatus comprising:

a photosensitive body rotatable in a predetermined direction;

a charging member that charges a surface of said photosensitive body by contact with said photosensitive body;

an exposure device that exposes the surface of said photosensitive body charged by said charging member to light in order to produce an electrostatic latent image;

temperature detecting means for detecting a temperature of said charging member;

voltage correcting means for correcting a voltage to be applied to said charging member;

amount-of-light correcting means for correcting an amount of exposure light of said exposure device;

aging change detecting means for detecting an aging change of said photosensitive body;

correction rule changing means for changing a correction rule for the applied voltage corrected by said voltage correcting means in accordance with an amount of aging change detected by said aging change detecting means; and potential correcting means for correcting a potential of the surface of said photosensitive body which has been charged in an image forming process proceeding from charge to transfer on the basis of a detection result obtained in such a way that a voltage corrected by said voltage correcting means is applied to said charging member in order to charge the surface of said photosensitive body and then electricity of said photosensitive body is removed and a residual potential after the removal is detected;

wherein, when a detection result obtained by said temperature detecting means is lower than a predetermined temperature value, said voltage correcting means first makes correction of the applied voltage under another correction rule presented by said correction rule changing means, and consecutively said amount-of-light correcting means makes correction of the amount of exposure light.

5. An image forming apparatus according to claim 4, wherein the correction rule is changed if a detection result obtained by said aging change detecting means exceeds a predetermined value after completion of the image forming job.

6. An image forming apparatus according to claim 4, further comprising cleaning means for cleaning said charging member before corrections are made by said amount of-light correcting means and said potential correcting means.

7. An image forming apparatus according to claim 6, wherein said charging member is cleaned by said cleaning means if the temperature detected by said temperature detecting means is lower than a predetermined threshold value.

8. An image forming apparatus according to claims 4 or 6, wherein said amount-of-light correcting means and said potential correcting means make the respective corrections if the temperature detected by said temperature is lower than a predetermined threshold value.

9. An image forming apparatus according to claims 4 or 6, wherein said amount-of-image correcting means and said potential correcting means make the respective corrections if the temperature detected by said temperature detecting means is lower than a predetermined threshold value and then exceeds the threshold value.

10. An electrophotographic type of image forming apparatus comprising a photosensitive body rotatable in a predetermined direction, a charging member that charges a surface of said photosensitive body by contact with said photosensitive body, an exposure device that exposes the surface of said photosensitive body charged by said charging member to light in order to produce an electrostatic latent image, temperature detecting means for detecting temperature of said charging member, voltage correcting means for correcting a voltage to be applied to said charging member, and amount-of-light correcting means for correcting an amount of exposure light of said exposure device, wherein, when a detection result obtained by said temperature detecting means is lower than a predetermined temperature value, said voltage correcting means first makes correction of the applied voltage under another correction rule presented by said correction rule changing means, and consecutively said amount-of-light correcting means makes correction of the amount of exposure light.

* * * * *